US006419541B1

(12) United States Patent
Apichom

(10) Patent No.: US 6,419,541 B1
(45) Date of Patent: Jul. 16, 2002

(54) DEVICE FOR COLLECTING TREATS

(76) Inventor: Surasak Apichom, 2125 Ohio Ave., #G, Signal Hill, CA (US) 90804

( * ) Notice: Subject to any disclaimer, the term of this patent is extended or adjusted under 35 U.S.C. 154(b) by 0 days.

(21) Appl. No.: 09/718,641

(22) Filed: Nov. 22, 2000

(51) Int. Cl.[7] ..... A63H 3/00

(52) U.S. Cl. ..... 446/73; 446/185; 446/199; 446/330

(58) Field of Search ..... 446/71, 73, 74, 446/180, 183, 184, 185, 197, 198, 199, 308, 309, 330; 294/19.2; 206/457

(56) References Cited

U.S. PATENT DOCUMENTS

| | | | | | |
|---|---|---|---|---|---|
| 2,203,562 | A | | 6/1940 | Edwards | |
| 2,559,909 | A | * | 7/1951 | Wescott | 446/185 |
| 2,592,347 | A | * | 4/1952 | Shute | 446/197 |
| 3,740,893 | A | * | 6/1973 | Shinoda | 446/190 |
| 3,883,982 | A | | 5/1975 | McClary | |
| 4,271,620 | A | * | 6/1981 | Vicino et al. | 40/406 |
| 4,689,033 | A | * | 8/1987 | Droller et al. | 446/183 |
| 4,828,526 | A | * | 5/1989 | Schneider et al. | 446/183 |
| 5,125,177 | A | * | 6/1992 | Colting | 446/226 |
| 5,205,773 | A | * | 4/1993 | Koepcke et al. | 446/183 |
| 5,261,850 | A | * | 11/1993 | Barthold | 446/180 |
| 5,297,980 | A | * | 3/1994 | Barthold | 446/180 |
| 5,380,234 | A | * | 1/1995 | Ledford | 446/223 |
| 5,504,943 | A | | 4/1996 | Han | |
| 5,531,575 | A | | 7/1996 | Lin | |
| 5,787,508 | A | | 8/1998 | Gattamorta | |
| D397,583 | S | | 9/1998 | Allison | |
| D404,263 | S | | 1/1999 | Allison | |
| D414,087 | S | | 9/1999 | Allison | |
| 5,970,522 | A | | 10/1999 | Apichom | |
| 6,119,581 | A | | 9/2000 | Po | |

* cited by examiner

*Primary Examiner*—Jacob K. Ackun
*Assistant Examiner*—Faye Francis
(74) *Attorney, Agent, or Firm*—Eric Karich

(57) ABSTRACT

A device for collecting treats has a handle having a first end and a second end. A basket is connected to the first end of the handle, the basket including an opening shaped to receive treats. The handle is shaped to allow a user to grasp the second end of the handle and extend the basket to a giver, who drops treats in the basket. The device includes an inflatable sack positioned at the first end of the handle. A feature shaped to resemble a scary creature such as a snake or rat is positioned around the inflatable sack. The device includes a pump. Inflating the inflatable sack with the pump causes the feature to move from a retracted position in which the feature is unobtrusive, to a protruding position in which the feature protrudes from the end of the handle thereby generating a startling effect to the giver. A coil spring attached to the feature then functions to return the feature to the retracted position.

5 Claims, 4 Drawing Sheets

DEVICE FOR COLLECTING TREATS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to devices for collecting treats, and more particularly to a collecting device having features that jump outwardly to startle the givers.

2. Description of Related Art

Various devices have been invented for use during the Halloween season. For example, various inventions disclose costume masks that have features to startle or amuse observers. Apichom, U.S. Pat. No. 5,970,522, teaches a costume mask having an inflatable sack that causes a feature to protrude in a startling fashion. Edwards, U.S. Pat. No. 2,203,562, teaches a false face having features that protrude in response to air blown into various chambers of the false face. McClary, U.S. Pat. No. 3,883,982, teaches a mask having a kazoo mounted therein. Han, U.S. Pat. No. 5,504,943, teaches a headgear that includes a built-in whistle. Gattamorta, U.S. Pat. No. 5,787,508, teaches a decorative mask assembly.

Various collecting containers and sacks useful for collecting treats are also known in the art. U.S. Pat. No. D393,186, and U.S. Pat. No. D404,263, teach collecting devices having a basket on a handle useful for collecting treats. These devices include colorful features such as a hand with protruding fingernails. U.S. Pat. No. D414,087 discloses a similar collecting device but with a handle that appears like an extended hairy arm similar to that of a gorilla. U.S. Pat. No. D397,583 discloses a similar device with an end designed like a person's mouth with protruding tongue and teeth.

The prior art teaches various toys and devices for use during the Halloween season. However, the prior art does not teach a treat collecting device having an end that incorporates a feature that jumps outwardly to startle a person attempting to place a treat into the sack. The present invention fulfills these needs and provides further related advantages as described in the following summary.

SUMMARY OF THE INVENTION

The present invention teaches certain benefits in construction and use which give rise to the objectives described below.

The present invention provides a device for collecting treats. The device includes a handle having a first end and a second end. A basket is connected to the first end of the handle, the basket including an opening shaped to receive treats. The handle is shaped to allow a user to grasp the second end of the handle and extend the basket to a giver, who drops treats in the basket. The device includes an inflatable sack positioned at the first end of the handle. A feature shaped to resemble a scary creature such as a snake or rat is positioned around the inflatable sack. The device includes a means for inflating the inflatable sack. Inflating the inflatable sack causes the feature to move from a retracted position in which the feature is unobtrusive, to a protruding position in which the feature protrudes from the end of the handle thereby generating a startling effect to the giver. A means for retracting the feature then functions to return the feature to the retracted position.

A primary objective of the present invention is to provide a device for collecting treats having advantages not taught by the prior art.

Another objective is to provide a device for collecting treats that includes a feature that can jump quickly and unexpectedly from a treat collecting basket to startle and amuse.

A further objective is to provide a device for collecting treats that quickly returns to a retracted position, ready to startle another person.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
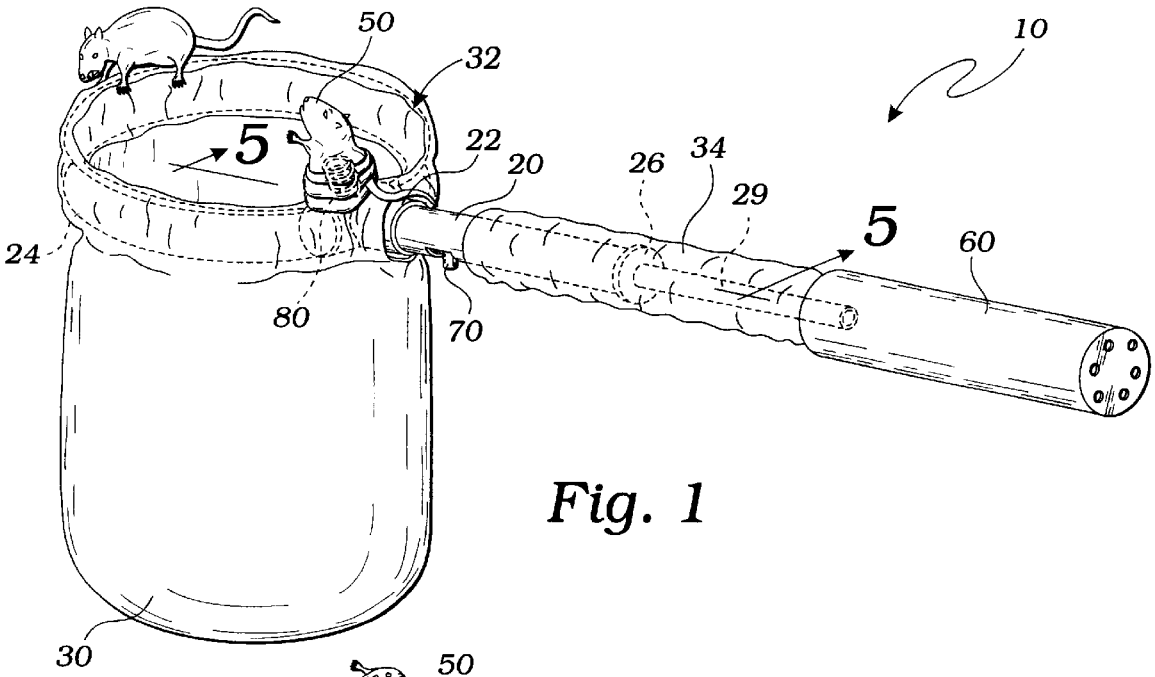
FIG. 1 is a perspective view of the preferred embodiment of the present invention, the view illustrating a feature resembling a rat in a retracted position.

The above described drawing figures illustrate the invention, a device 10 for collecting treats. The device 10 includes a handle 20 having a first end 22 and a second end 26. A basket 30 is connected to the first end 22 of the handle 20, the basket 30 including an opening 32 shaped to receive treats. The handle 20 is shaped to allow a user to grasp the second end 26 of the handle 20 and extend the basket 30 to a giver, who drops treats in the basket 30. The device 10 includes an inflatable sack 40 positioned at or adjacent to the first end 22 of the handle 20.

A feature 50 shaped to resemble a scary creature such as a snake or rat is positioned around, or is integral with, the inflatable sack 40. The device 10 includes a means for inflating 60 the inflatable sack 40. Inflating the inflatable sack 40 causes the feature 50 to move from a retracted position in which the feature 50 is unobtrusive, to a protruding position in which the feature 50 protrudes from the end of the handle 20 thereby generating a startling effect to the giver. A means for retracting 80 the feature 50 then functions to return the feature 50 to the retracted position.

As shown in FIGS. 1–9, the handle 20 is a rigid, elongate body and preferably includes a circular portion 24 at the first end 22 for supporting the basket 30 in an open configuration. The second end 26 is adapted to operably engage the means for inflating 60, preferably a hand pump, as described below. The handle 20 is preferably tubular and includes an interior conduit 28 for directing a fluid such as air from the hand pump 60 at the second end 26 of the handle 20 to the inflatable sack 40 at the first end 22 of the handle 20. The handle 20 is constructed of a rigid, lightweight material, preferably plastic, although other materials such as wood, steel, or graphite, are all acceptable. The basket 30 is constructed to receive the treats and is preferably constructed of a lightweight and flexible material such as cotton, silk, or polyester, although other materials, even rigid materials such as plastic, are all acceptable. The basic structure of a treat collector is generally shown in U.S. Pat. No. D393,186, U.S. Pat. No. D404,263, U.S. Pat. No. D414,087, and U.S. Pat. No. D397,583, hereby incorporated by reference in full.

The novel feature 50 of the current device 10 is the combination of the handle 20 with the inflatable sack 40 and the feature 50. The inflatable sack 40 is an elongate balloon-like bag or container that can be quickly inflated, thereby causing the inflatable sack 40 to expand quickly outwardly. The inflatable sack 40 is preferably made of a thin elastic material such as rubber, latex, or similar material. The thin, elongate nature of the inflatable sack 40 allows the feature 50 to leap outwardly in a fast and startling manner.

Figure 2:
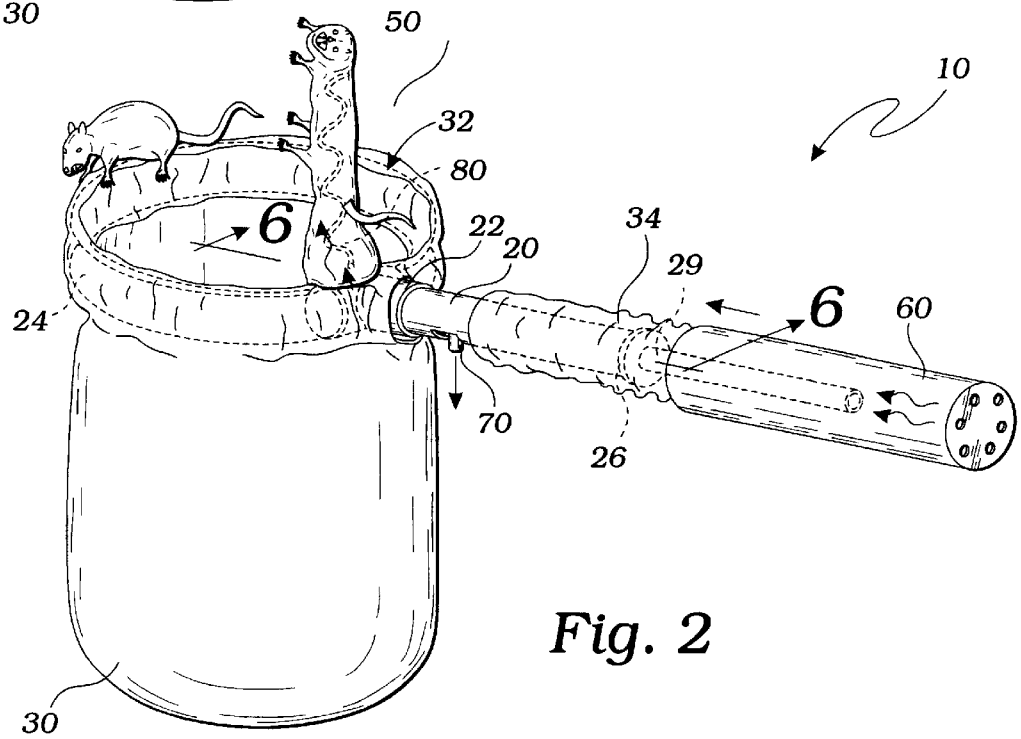
FIG. 2 is a perspective view thereof illustrating the feature moving to a protruding position in response to the actuation of a hand pump.
Figure 3:
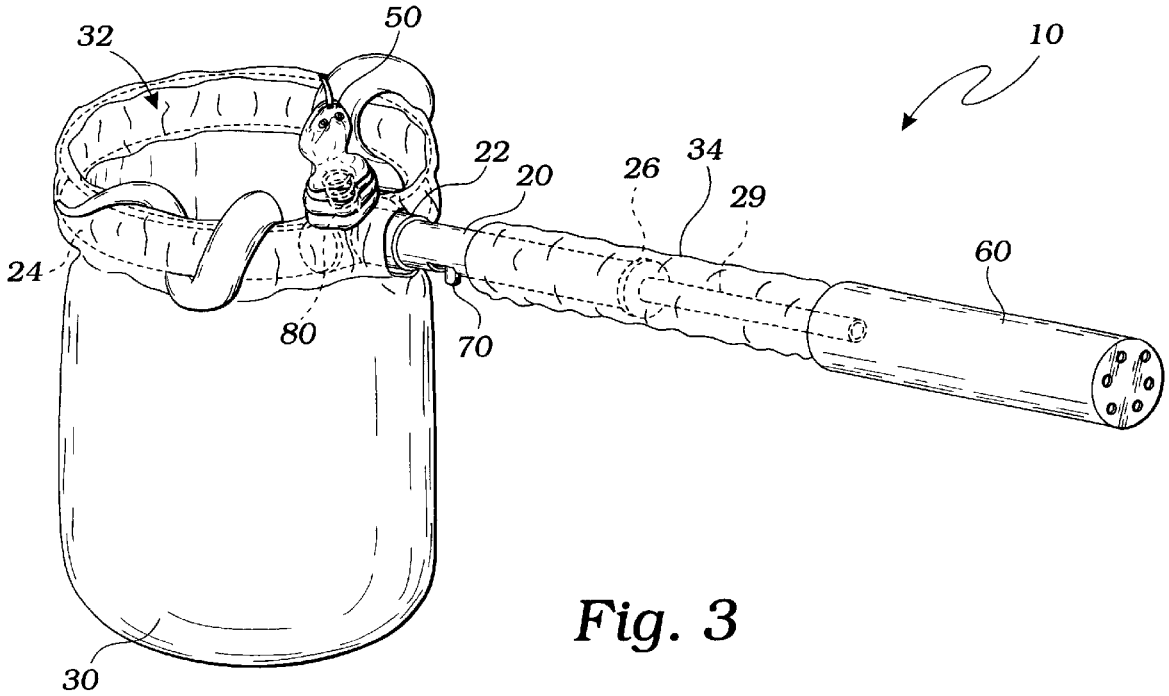
FIG. 3 is a perspective view of an alternative embodiment, in which the feature resembles a snake.
Figure 4:
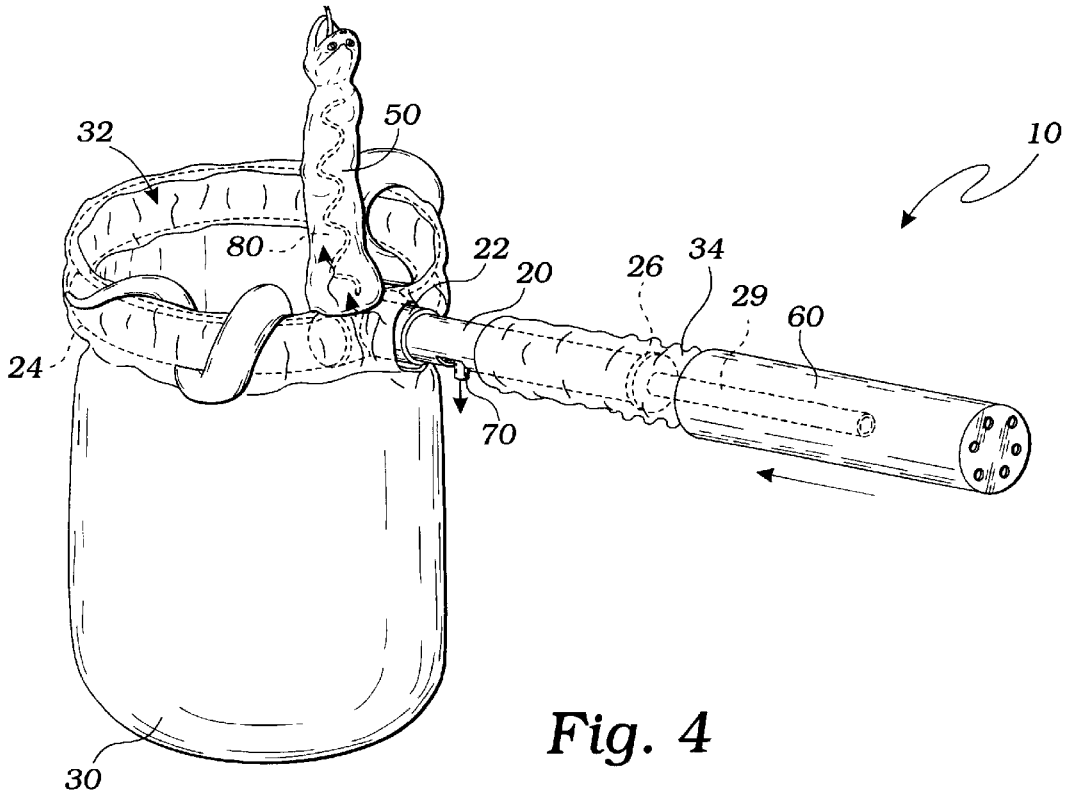
FIG. 4 is a perspective view thereof illustrating the feature moving to a protruding position in response to the reverse actuation of the hand pump.
Figure 5:
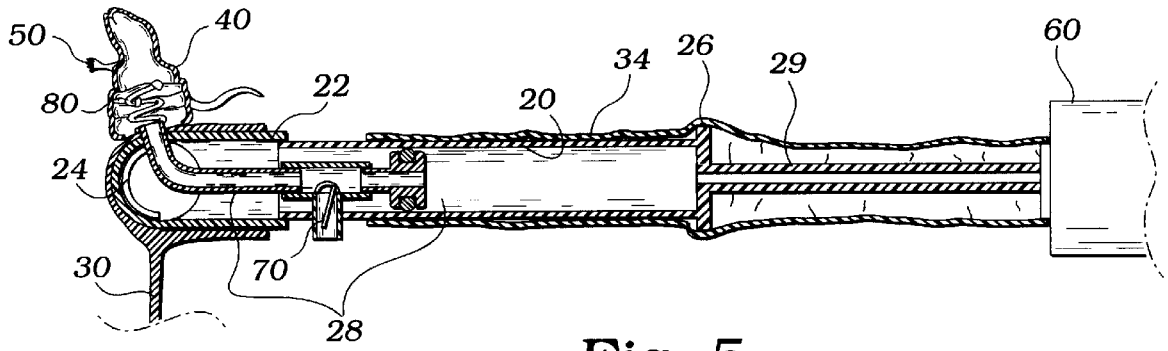
FIG. 5 is a sectional view thereof taken along line 5—5 in FIG. 1
Figure 6:
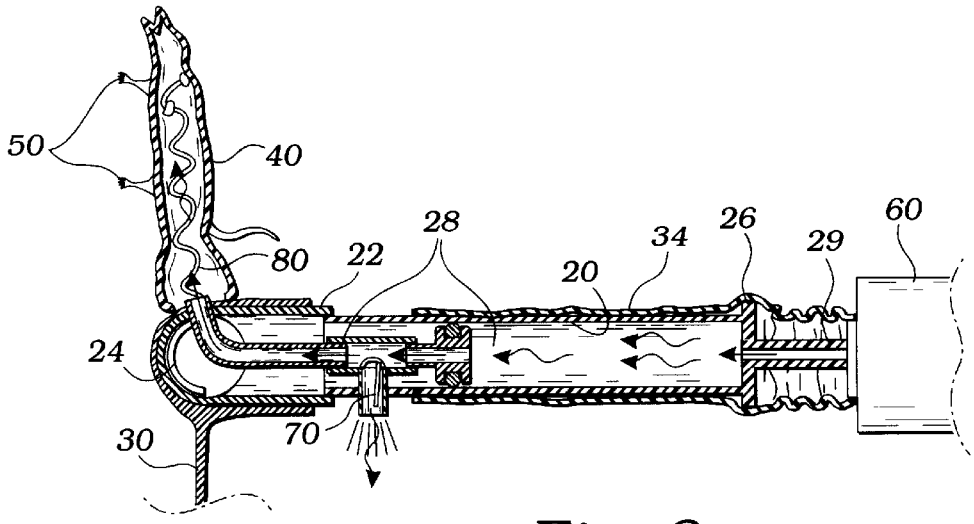
FIG. 6 is a sectional view thereof taken along line 6—6 in FIG. 2.
Figure 7:
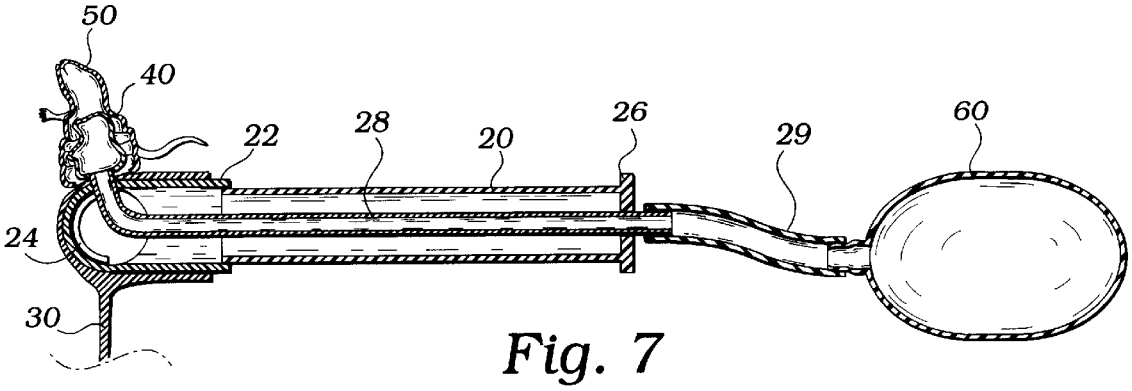
FIG. 7 is a sectional view of an alternative embodiment wherein the hand pump is a resilient ball, the view illustrating the feature in a retracted position.
Figure 8:
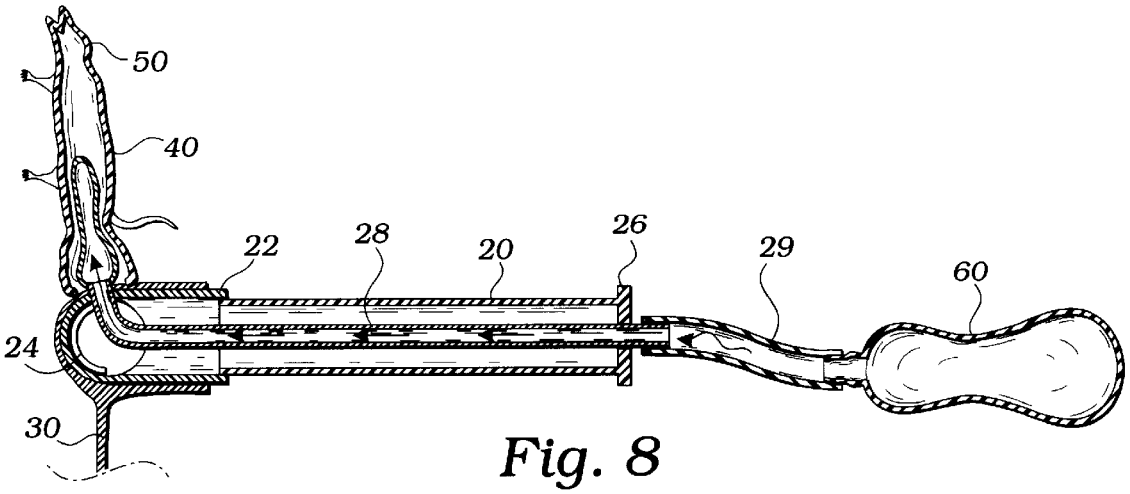
FIG. 8 is a sectional view thereof illustrating the feature moving to a protruding position in response to the compression of the resilient ball.
Figure 9:
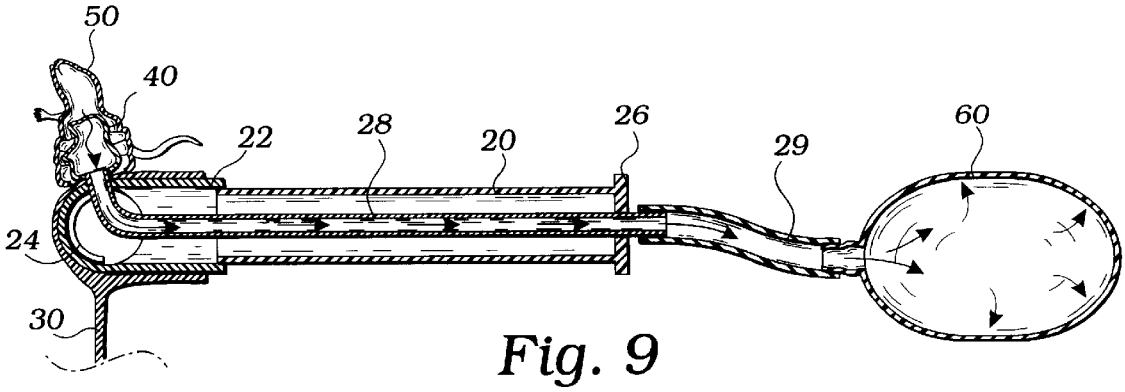
FIG. 9 is a sectional view thereof illustrating how the resilient ball returns to its original shape, thereby returning the feature to the retracted position.

The inflatable sack 40 is covered by, or integral with, the feature 50 which resembles a creature such as a snake or rat, a scary monster, or other frightening or amusing creature, figure, or symbol. The feature 50 is preferably designed to resemble an animal such as a rat, as shown in FIGS. 1 and 2, or a snake, as shown in FIGS. 3 and 4, although those skilled in the art can devise many creative designs to startle and amuse. As shown in FIGS. 5 and 6, the feature 50 is preferably molded into the inflatable sack 40 so that the inflatable sack 40 and the feature 50 are constructed from a single material. In an alternative embodiment, as shown in FIGS. 7–9, the feature 50 is constructed from a light material such as nylon or cloth and is shaped to fit over the inflatable sack 40 and expand outwardly with the expansion of the inflatable sack 40. Both the inflatable sack 40 and the feature 50 should be constructed of a thin and lightweight material to enable the inflatable sack 40 and feature 50 to inflate and deflate quickly, thereby causing the feature 50 to leap quickly outward at the giver for startling effect.

The device 10 is actuated by a means for inflating 60 the inflatable sack 40. The means for inflating 60 expands the inflatable sack 40 thereby moving the feature 50 from the retracted position, as shown in FIGS. 1 and 3, to the protruding position, as shown in FIGS. 2 and 4. The means for inflating 60 is preferably a hand pump 60 located at a second end 26 of the handle 20, as shown in FIGS. 1–6. The hand pump 60 is preferably a pump cylinder connected to the second end 26 of the handle 20 by a pump conduit 29 which is operably connected to the inflatable sack 40 by an interior conduit 28. The pump conduit 29 is preferably covered with a flexible concealment sleeve 34 so as to conceal the nature of the device 10. In the preferred embodiment, as shown in FIGS. 1–4, the hand pump 60 is a dual-action pump such as disclosed in Lin, U.S. Pat. No. 5,531,575; however, a more standard single-action cylindrical pump taught by Po, U.S. Pat. No. 6,119,581, is also acceptable. In an alternative embodiment, as shown in FIGS. 7–9, the hand pump 60 is resilient squeeze bulb. The hand pump 60 is manually movable from a first position in which a fluid is located in the hand pump 60 and the inflatable sack 40 is deflated, to a second position in which the fluid is forced from the hand pump 60 into the inflatable sack 40, thereby inflating the inflatable sack 40 and moving the feature 50 from the retracted position to the protruding position.

Once the inflatable sack 40 has been inflated, it is preferably able to immediately deflate so that the means for retracting 80 can return the inflatable sack 40 to the retracted position. In the preferred embodiment, a noisemaker 70 is preferably also attached to the means for inflating 60 such that when the means for inflating 60 is used to inflate the inflatable sack 40, the means for inflating 60 also actuates the noisemaker 70. The noisemaker 70 is preferably a whistle 70 that emits a startling shriek as the feature 50 leaps outwardly at the giver. Not only does this enhance the amusement value of the device 10, it also allows the fluid to escape from the inflatable sack 40, thereby allowing the inflatable sack 40 to return to the retracted position.

The means for retracting 80, as shown in FIGS. 5 and 6, is preferably a coil spring that connects the inflatable sack 40 and/or the feature 50 to the first end 22 of the handle 20. While the coil spring 80 is preferred, a variety of elastic, resilient structures can be devised by those skilled in the art to bias the feature 50 towards the retracted position. Inflating the inflatable sack 40 by actuating the hand pump 60 temporarily overcomes the bias of the coil spring 80, causing the feature 50 to leap outward to an extended position, shown in FIGS. 2 and 4. In the preferred embodiment, this movement is accompanied by the shrill shriek of the whistle 70. When the user quits pumping, the inflatable sack 40 deflates, and the coil spring 80 pulls the feature 50 back to the retracted position.

In an alternative embodiment, as shown in FIGS. 7–9, the means for inflating 60 and the means for retracting 80 are both provided by the hand pump 60. In this embodiment, the hand pump 60 is connected to the inflatable sack 40 by a closed conduit that does not have any openings or-the whistle 70. As shown in FIGS. 7 and 8, when the hand pump 60 is manually actuated, the fluid that was located in the hand pump 60 is directed into the inflatable sack 40, thereby inflating the inflatable sack 40 and moving the feature 50 from the retracted position to the protruding position. Then the hand pump 60 is allowed to return to the starting position, either through the manual actuation of the cylindrical hand pump 60 or because of the natural resilience of the resilient squeeze bulb, the fluid is pulled from the inflatable sack 40 and back into the hand pump 60. This forced deflation of the inflatable sack 40 causes the feature 50 to return to the retracted position without the use of the coil spring 80. The advantage of this embodiment is that the device 10 can be made without the coil spring 80; however, the disadvantage is that it is not possible to include the whistle 70 as described above.

In its most preferable use, the user utilizes the collecting device 10 to collect treats from while "trick or treating" during the Halloween holiday. While the user walks from house to house, the feature 50 remains in the retracted position under the bias of the means for retracting 80, as shown in FIGS. 1, 3, 5, and 7. When the user wishes to collect treats, the user grasps the handle 20 by the second end 26 and extends the basket 30 and the first end 22 of the handle 20 towards the giver so that the giver could put treats into the basket 30. When the user wishes to startle the giver as well, the user actuates the hand pump 60 to drive the fluid from inside of the hand pump 60 into the inflatable sack 40, thereby causing the feature 50 to move from the retracted position to the protruding position, as shown in FIGS. 2, 4, 6, and 8. In the preferred embodiment shown in FIGS. 2, 4, and 6, in which the device 10 includes a whistle 70, the abrupt movement is accompanied by the simultaneous shriek of the whistle 70, thus generating a startling effect to the giver.

When the user then ceases to actuate the hand pump 60, as shown in FIGS. 1, 3, 5, and 9, the means for retracting 80 returns the feature 50 to the retracted position, ready concealing the feature 50 and readying the device 10 to startle another giver. For purposes of illustration and clarity, the feature 50 has been shown in a prominent location on the first end 22 of the handle 20. In alternative embodiment, however, the feature 50 will often be concealed within the basket 30 or otherwise so that the giver does not suspect a startling trick. Only when the giver is reaching out towards the device 10, and the user actuates the device 10, does the feature 50 emerge from the basket 30 to startle the giver.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A device for collecting treats, the device comprising:

a handle having a first end;

a basket having an opening, the basket being connected to the first end of the handle an inflatable sack positioned adjacent the first end of the handle;

a feature positioned around the inflatable sack, the feature being movable from a retracted position in which the feature is unobtrusive, to a protruding position in which the feature protrudes from the end of the handle;

a means for inflating the inflatable sack, the inflatable sack expanding to move the feature from the retracted position to the protruding position; and a means for retracting the feature from the protruding position to the retracted position.

2. The device of claim 1 wherein the means for inflating is a hand pump located at a second end of the handle, the hand pump being operably connected to the inflatable sack by an open conduit, the hand pump being manually movable from an inflated position in which a fluid is located in the hand pump and the inflatable sack is deflated, to a deflated position in which the fluid is forced from the hand pump into the inflatable sack, thereby inflating the inflatable Sack and moving the feature from the retracted position to the protruding position; and wherein the means for retracting is a coil spring that connects the feature to the end of the handle, the coil spring being biased towards the retracted position.

3. The device of claim 1 further comprising of a noisemaker attached to the means for inflating such that when the means for inflating is used to inflate the inflatable sack, the means for inflating also actuates the noisemaker.

4. The device of claim 3 wherein the noisemaker is a whistle.

5. The device of claim 1 wherein the means for inflating and the means for retracting are provided by a hand pump located at a second end of the handle, the hand pump being operably connected to the inflatable. sack by a closed conduit, the hand pump being manually movable from a inflated position in which a fluid is located in the hand pump and the inflatable sack is deflated, to a deflated position in which the fluid is forced into the inflatable sack, thereby inflating the inflatable sack and moving the feature from the retracted position to the protruding position, whereby returning the hand pump to the inflated position causes the fluid to return to the hand pump, thereby deflating the inflatable sack and returning the feature to the retracted position.

* * * * *